US006151903A

United States Patent [19]

Hironaka

[11] Patent Number: 6,151,903

[45] Date of Patent: Nov. 28, 2000

[54] AIR CONDITIONING APPARATUS AND AIR CONDITIONING METHOD FOR REDUCING ELECTRIC POWER CONSUMPTION BY REDUCING PRESSURE LOSS IN CIRCULATION AIR

[75] Inventor: Takanori Hironaka, Tokyo, Japan

[73] Assignee: NEC Corporation, Tokyo, Japan

[21] Appl. No.: 09/333,968

[22] Filed: Jun. 16, 1999

[30] Foreign Application Priority Data

Jun. 25, 1998 [JP] Japan ..... 10-179336

[51] Int. Cl.[7] ..... F25B 49/00; F25D 17/04

[52] U.S. Cl. ..... 62/176.6; 62/186; 62/408; 62/414; 62/415; 454/187; 454/233; 454/236

[58] Field of Search ..... 62/176.6, 186, 62/408, 413, 414, 415, 417; 454/187, 236, 233

[56] References Cited

U.S. PATENT DOCUMENTS 4,873,914 10/1989 Hirayama et al. ..... 98/31.6
5,096,477 3/1992 Shinoda et al. ..... 55/385.2

FOREIGN PATENT DOCUMENTS 4-103937 4/1992 Japan .
7-4724 1/1995 Japan .
8-152170 6/1996 Japan .
9-159239 6/1997 Japan .
9-287791 11/1997 Japan .

*Primary Examiner*—William Doerrler
*Assistant Examiner*—Marc Norman
*Attorney, Agent, or Firm*—Sughrue, Mion, Zinn, Macpeak & Seas, PLLC

[57] ABSTRACT

In an air conditioning apparatus, it includes a clean room, an air cleaning section, a cooling section and an air mixing section. The air cleaning section cleans air to supply to the clean room as cleaned air. The cooling section includes a plurality of cooling units and a plurality of non-cooling units. A plurality of cooling units cool air from the clean room to send out as cooled air. A plurality of non-cooling units sends out as non-cooled air from the clean room without cooling air. Each of the quantity of the cooled air and the non-cooled air is determined to compensate an amount of heat generated in the air conditioning apparatus and to reduce a pressure loss given to the air passing through the cooling section to a substantial minimum. The air mixing section mixes the cooled air and the non-cooled air to supply to the air cleaning section. The cleaned air is circulated through the clean room, the cooling section and the air mixing section to the air cleaning section.

21 Claims, 7 Drawing Sheets

AIR CONDITIONING APPARATUS AND AIR CONDITIONING METHOD FOR REDUCING ELECTRIC POWER CONSUMPTION BY REDUCING PRESSURE LOSS IN CIRCULATION AIR

BACKGROUND OF THE INVENTION

1. Field of the Invention

The present invention relates to an air conditioning apparatus and an air conditioning method for reducing a pressure loss of circulation air to reduce electric power consumption for circulating circulation air in the air conditioning apparatus.

2. Description of the Related Art

A method for manufacturing a semiconductor device needs a process of using a hyperfine machining treatments. Associated with this process, dust existing in manufacture space for the semiconductor device invades the semiconductor device at a process of manufacturing the semiconductor device, and this invasion may cause the semiconductor device to be defective. Also, the change of temperature or humidity in the manufacture space may cause slight curvature or distortion to be incurred in a material used for the manufacture, which thereby may cause the semiconductor device to be defective. For dropping the rate of the defective device, it is necessary to reduce the quantity of the dust existing in the manufacture space and also necessary to keep the temperature and the humidity in the manufacture space constant. In response to above-mentioned request, the space is developed which is referred to as a clean room where the dust is reduced as much as possible and the temperature and the humidity are kept constant.

FIGS. 1A and 1B show a conventional clean room air conditioning apparatus using a FFU (Fan Filter Unit). FIG. 1A is a front section view showing this conventional clean room air conditioning apparatus. FIG. 1B is a side section view showing this conventional clean room air conditioning apparatus.

Referring to FIGS. 1A and 1B, the conventional clean room air conditioning apparatus using the FFU is provided with FFUs 41, a clean room interior 42, an under-floor portion 43, a cooling coil 44, and a return shaft 45.

FFUs 41 are set on a top surface of a clean room interior 42. A cooling coil 44 is set in an under-floor portion 43 of the clean room. A return shaft 45 is set outside the clean room for controlling a temperature of air passing through the cooling coil 44.

In the conventional clean room air conditioning apparatus using the FFU, the air is circulated in an order of an air flow 401, an air flow 402, an air flow 403 and an air flow 404 shown in FIG. 1A.

Refer to FIGS. 1A and 1B, the operation of the clean room air conditioning apparatus using the conventional FFU will be described below.

At first, air cleaned by the FFUs 41 is perfectly passed through the clean room interior 42, the under-floor portion 43 and the cooling coil 44. The air is cooled when the air passes through the cooling coil 44. The temperature of the cooled air is controlled by the return shaft 45 and returned to the FFUs 41.

The air conditioning apparatus according to the conventional technique shown in FIGS. 1A and 1B has a problem that a pressure loss of the circulation air in the clean room is large. One of the reasons is that the circulation air perfectly passes through the cooling coil which has the large pressure loss, when the quantity of circulation wind is determined not for cooling heat generated in the clean room but for keeping a room clean at a certain degree.

Also, this has a problem that a pressure loss outside the FFUs set on a ceiling surface is large to thereby cause energy required by the FFUs to be large. The reason is that a fan set in the FFU generates a wind pressure to compensate the pressure loss resulting from the air circulation. Thus, the pressure corresponding to the large pressure loss generated when the air is passed through the cooling coil is also attributed to the wind pressure generated by the fan.

Moreover, another conventional techniques with regard to the clean room air conditioning apparatus will be described below. At first, Japanese Laid-Open Patent Application (JP-A-Heisei 4-103937) describes "Method for Controlling Wind Quantity of Clean Room". This conventional technique has the following feature. A fan motor of FFU is composed of a single-phase motor in which rotation speeds can be changed in a plurality of stages by an operation of tap changing. An operational terminal unit for carrying out an ON-OFF operation and a tap changing operation of the single-phase motor is mounted for each FFU. A transmission line is laid for transmitting an operational command to each operational terminal device. The drive number of FFUs and the blown-out wind speeds from the FFUs are controlled through the remote operations of those operational terminal devices.

Japanese Laid-Open Patent Application (JP-A-Heisei 7-4724) describes "Method for Controlling And Saving Energy of Air Conditioning System". This conventional technique has the following feature. Air inside a room is sucked into an air conditioning apparatus through an air filter by a fan motor. A temperature of the sucked air is measured by an sensor set at a sucked air unit in the air conditioning apparatus. The air sucked into the air conditioning apparatus is cooled by a cooling unit, and again heated by a re-heating unit, and humidified by a humidifier, and then blown from the air conditioning apparatus. The temperature and the humidity of the blown air are measured by an sensor set outside the air conditioning apparatus. The wind quantity is controlled in accordance with a present wind rate and a temperature difference measured by the sensor set at a sucked air unit and the sensor set outside the air conditioning apparatus. The cooling quantity is controlled in accordance with the controlled wind quantity. Moreover, an open degree of a bypass damper for bypassing the air passed through the cooling unit is controlled in accordance with the humidity measured by the sensor set outside the air conditioning apparatus.

Japanese Laid-Open Patent Application (JP-A-Heisei 9-159239) describes "Clean Room". This conventional technique has the following feature. This is provided with a plate-shaped member with many holes set in the vicinity of a blowing port of FFU and an air releasing unit which is spaced away from the FFU and set substantially opposite to the FFU. An opening rate adjusted on the basis of the plate-shaped hole with the many holes is different depending on the set or non-set position of the FFU.

Japanese Laid Open Patent Application (JP-A-Heisei 9-287791) describes "Filter Unit And Clean Room Having Chamber". This conventional technique has the following feature. A plurality of FFUs are set removed, and a floor surface having an opening is placed in the clean room. The FFU is covered with a small chamber whose bottom surface is open and which is box-shaped and used for ceiling suck. An air intake is created around an air outtake of the FFU. A fan of the FFU is used to carry out the air blowout from the FFU and the air suck to the small chamber at the same time. It is possible to adjust a valve mounted at the air intake on a top surface of the small chamber to thereby adjust the balance between the quantity of the air suck from the ceiling and the quantity of the air suck to the small chamber.

Japanese Laid Open Patent Application (JP-A-Heisei 8-152170) describes "Structure of Clean Room". This conventional technique has the following feature. At first, a ceiling surface is made into an air filter surface provided with a plurality of air filters. Then, a clean room is created in which air is passed along a floor surface. Duct space for air circulation is disposed in portion outside the clean room. A cooling coil having a fan on a rear side thereof is set on a circulation path of the portion outside the clean room.

SUMMARY OF THE INVENTION

The present invention has been made to solve the above-explained problems.

Therefore, an object of the present invention is to provide an air conditioning apparatus and an air conditioning method which can reduce electric power consumption for circulating circulation air by reducing a pressure loss given to circulation air, when the quantity of circulation air is determined not for cooling heat generated in the clean room but for keeping a room clean.

Another object of the present invention is to provide an air conditioning apparatus and an air conditioning method which can be adjusted to a quantity of air passed through a cooling coil in response to a change of an amount of heat generated in the air conditioning apparatus or an amount of dust in the air conditioning apparatus. In order to achieve an aspect of the present invention, an air conditioning apparatus includes a clean room, an air cleaning section, a cooling section and an air mixing section. The air cleaning section cleans air to supply to the clean room as cleaned air. The cooling section includes a plurality of cooling units and a plurality of non-cooling units. A plurality of cooling units cool air from the clean room to send out as cooled air. A plurality of non-cooling units sends out as non-cooled air from the clean room without cooling air. Each of the quantity of the cooled air and the non-cooled air is determined to compensate an amount of heat generated in the air conditioning apparatus and to reduce a pressure loss given to the air passing through the cooling section to a substantial minimum. The air mixing section mixes the cooled air and the non-cooled air to supply to the air cleaning section. The cleaned air is circulated through the clean room, the cooling section and the air mixing section to the air cleaning section.

In the air conditioning apparatus, the air cleaning section may give a first pressure to the cleaned air to circulate the cleaned air through the clean room, the non-cooling unit in the cooling section and the air mixing section to the air cleaning section. And the cooling section may give a second pressure to the cooled air to compensate the pressure loss given to the air passing through the cooling unit.

In the air conditioning apparatus, the air cleaning section may include a fan filter unit. The fan filter unit including a filter and a fan. The fan sucks air and sends the sucked air to the filter. The filter cleans the air sent by the fan.

In the air conditioning apparatus, the cooling unit may include a cooling equipment and a fan motor. The cooling equipment cools the cooled air. The fan motor gives a fan pressure to the cooled air. The fan pressure compensates for a pressure loss given the cooled air passing through the cooling equipment.

In the air conditioning apparatus, the fan motor may further include a temperature measuring section and a temperature controller. The temperature measuring section measures a temperature of circulation air circulated in the air conditioning apparatus. The temperature controller stores a pre-determined temperature and controls a quantity of the circulation air passing through the cooling equipment based on a comparison with the measured temperature and the pre-determined temperature.

The air conditioning apparatus may further include a temperature measuring section and a temperature controller. The temperature measuring section measures a temperature of circulation air circulated in the air conditioning apparatus. The temperature controller stores a pre-determined temperature and controls a number of the fan motors driving based on a comparison with the measured temperature and the pre-determined temperature.

In the air conditioning, at least one of the cooling unit may include an air conditioning unit. The air conditioning unit adjusts a temperature and a humidity of the air passing through the air conditioning unit. And the cooling section may divide the air passing through the cooling section into the cooled air, non-cooled air and a conditioned air passing through the air conditioning unit to compensate an amount of heat generated in the air conditioning apparatus and to reduce the pressure loss given to the air passing through the cooling section to a substantial minimum.

The air conditioning apparatus may further include a temperature humidity measuring section and a temperature humidity controller. The temperature humidity measuring section measures a temperature and a measured humidity of circulation air. The temperature humidity controller stores a pre-determined temperature and a pre-determined humidity of the circulation air and controls a quantity of the cooled air and the conditioned air based on a comparison with the measured temperature and the pre-determined temperature and another comparison with the measured humidity and the pre-determined humidity.

The air conditioning apparatus may further include a temperature humidity measuring section and a temperature humidity controller. The temperature humidity measuring section measures a temperature and a humidity of the circulation air. The temperature humidity controller stores a pre-determined temperature and a pre-determined humidity of the circulation air and controls the numbers of the air controlling units to be driven and the cooling units to be driven, based on a comparison with the measured temperature and the pre-determined temperature and another comparison with the measured humidity and the pre-determined humidity.

In the air conditioning apparatus, an arrangement of the cooling units, the non-cooling units and the air conditioning units may be changeable in the cooling section.

In the air conditioning apparatus, an arrangement of the cooling units and the bypass units may be changeable in the cooling section.

In order to achieve another aspect of the present invention, an air conditioning method of an air conditioning apparatus includes steps of (a), (b) and (c). The air conditioning apparatus includes a clean room, an air cleaning section and an air mixing section. The air cleaning section cleans air passing through the air cleaning section. The cooling section includes a plurality of cooling units of cooling air passing through the plurality of cooling units and a plurality of non-cooling units without cooling air passing through the plurality of non-cooling units. The air mixing section mixes the air passing through the plurality of cooling units and the air passing through the plurality of non-cooling units. The step of (a) is a step of giving a pressure to circulation air circulated in the air conditioning apparatus to circulate the circulation air through the clean room, the non-cooling unit in the cooling section and the air mixing section to the air cleaning section. The step of (b) is a step of dividing the circulation air passing through the cooling section into a first air passing through the plurality of cooling units and a second air passing through the plurality of non-cooling units to cool the first air based on an amount of heat generated in the air conditioning apparatus and to reduce a pressure loss given to the circulation air passing through the cooling section to a substantial minimum. The step of (c) is a step of giving to the first air a pressure substantially equal to a pressure loss given to the first air passing through the cooling unit.

In the air conditioning method, the step of (b) may include steps of (d), (e) and (f). The step of (d) is a step of determining a predetermined temperature. The step of (e) is a step of measuring a temperature of the circulation air before passing through the cooling section. The step of (f) is a step of dividing the circulation air passing through the cooling section into a quantity of the first air passing through the plurality of cooling units and a quantity of a second air passing through the plurality of non-cooling units based on a comparison with the measured temperature and the pre-determined temperature to reduce a pressure loss given to the air passing through the cooling section to a substantial minimum.

In the air conditioning method, the step of (c) may include a step of (g) controlling the quantity of the first air based on the result of the step of (f).

In the air conditioning method, a part of the cooling units may include air conditioning units of changing a temperature and a humidity of an air passing through the air conditioning units. And the step of (b) includes a step of (h). The step of (h) is a step of dividing the circulation air passing through the cooling section into a first air passing through the plurality of cooling units, a second air passing through the plurality of non-cooling units and a third air passing the air conditioning units to cool the first air and the third air in response to an amount of heat generated in the air conditioning apparatus and to reduce the pressure loss given to the circulation air passing through the cooling section to a substantially minimum. And the air conditioning method may further includes a step of (I). The step of (i) is a step of giving to the third air a pressure substantially equal to the pressure loss given to the third air passing through the air conditioning units.

The air conditioning method may further includes steps of (j) and (k). The step of (j) is a step of determining a pre-determined temperature and a pre-determined humidity. The step of (k) is a step of measuring a temperature and a humidity of the circulation air before passing through the cooling section. And the step of (h) may include a step of (l). The step of (l) is a step of dividing the circulation air passing through the cooling section into a first air passing through the plurality of cooling units, a second air passing through the plurality of non-cooling units and a third air passing the air conditioning units to cool the first air and the third air and to adjust a humidity of the third air based on a comparison with the measured temperature and the pre-determined temperature and another comparison with the measured humidity and the pre-determined humidity to reduce a pressure loss given to the circulation air passing through the cooling section to a substantial minimum.

In the air conditioning method, the step of (c) may further include a step of (m). The step of (m) is a step of controlling the quantity of the first air based on the step of (l). And the step of (i) may further include a step of (n). The step of (n) is a step of controlling the quantity of the third air based on the step of (l) .

In order to achieve still another aspect of the present invention, an air conditioning apparatus of a clean room includes an air cleaning portion, a cooling portion, an air mixing portion, an air circulating section. The air cleaning portion cleans air passing through the air cleaning section. The cooling portion includes a plurality of cooling units of cooling air passing through the cooling units; and a plurality of non-cooling units without cooling air passing through the non-cooling units. The air circulating section circulates a first air cleaned by the air cleaning section, through the clean room, the cooling portion and the air mixing portion to the air cleaning portion. The cooling section includes a dividing section and a cooling section. The dividing section divides the first air passing through the cooling section into a second air passing through the plurality of cooling units and a third air passing through the plurality of non-cooling unit. The cooling section cools the second air in the plurality of cooling units. The air mixing portion includes a mixing section mixing the second air cooled by the cooling section and the third air.

In the air conditioning apparatus of a clean room, each of the plurality of cooling units may include an cooling apparatus and an wind supplying apparatus supplying the second air to the cooling apparatus.

In the air conditioning apparatus of the clean room, the wind supplying apparatus may include a storing area, a first temperature measuring section and a controller. The storing area stores a pre-determined temperature. The first temperature measuring section measures a temperature of a circulation air circulated in the air conditioning apparatus. The controller controls a quantity of the second air supplied to the cooling apparatus based on a comparison with the measured temperature and the pre-determined temperature.

In the air conditioning apparatus of the clean room, the cooling section may further include a plurality of air conditioning units and a dividing section. The dividing section divides the first air passing through the cooling section into a second air passing through the plurality of cooling units, a third air passing through the plurality of non-cooling units and a fourth air passing through the plurality of air adjusting units. And the air conditioning unit may further include a storing area, a second temperature humidity measuring section and an adjusting section. The storing area stores a pre-determined temperature and a pre-determined humidity. The second temperature humidity measuring section measures a temperature and a measured of the circulation air. The adjusting section adjusts a temperature and a humidity of the fourth air passing through the air conditioning unit based on a comparison with the measured temperature and the pre-determined temperature and another comparison with the measured humidity and the pre-determined humidity. Moreover, the mixing section may mix the second air, the third air and the fourth air passing through the cooling section.

DESCRIPTION OF THE PREFERRED EMBODIMENTS

Referring now to drawings, various air conditioning apparatuses and air conditioning methods of the present invention will be described. The various air conditioning apparatuses and air conditioning methods of the present invention will be adapted to an air conditioning apparatus of a clean room using FFUs (Fan Filter Units). Here, the air conditioning apparatus of the present invention is adapted when the quantity of air circulated in the air conditioning apparatus is determined not for keeping cool from an amount of heat generated in the clean room but for keeping the clean room clean.

At first, an air conditioning apparatus according to a first embodiment of the present invention will be described below with reference to the attached drawings.

Figure 2A:
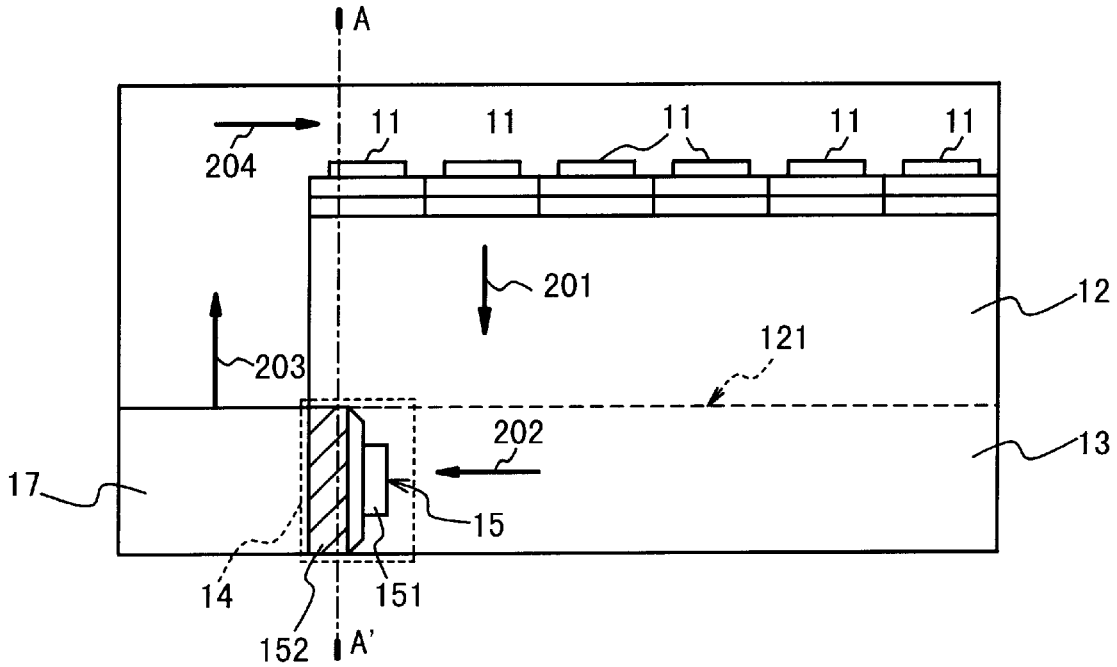
FIG. 2A is a section view showing a configuration of a first embodiment in an air conditioning apparatus of the present invention.
Figure 2B:
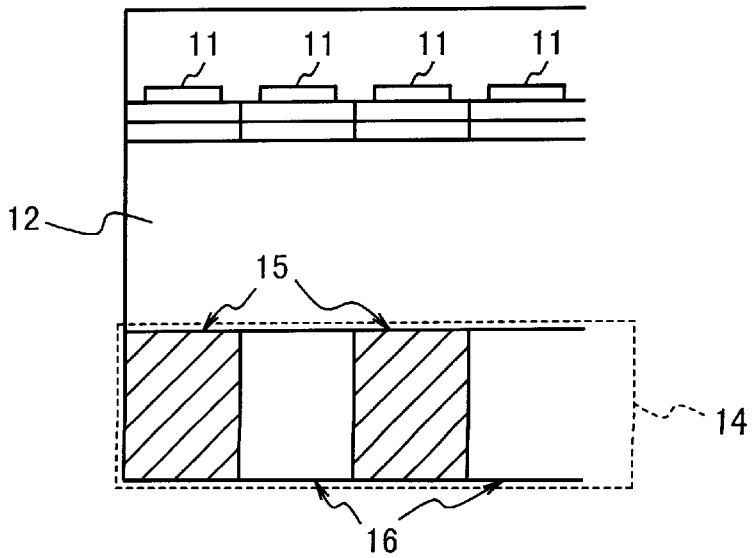
FIG. 2B is a view showing a part of a structure of a section taken on the line A-A' of FIG. 2A.
Figure 2C:
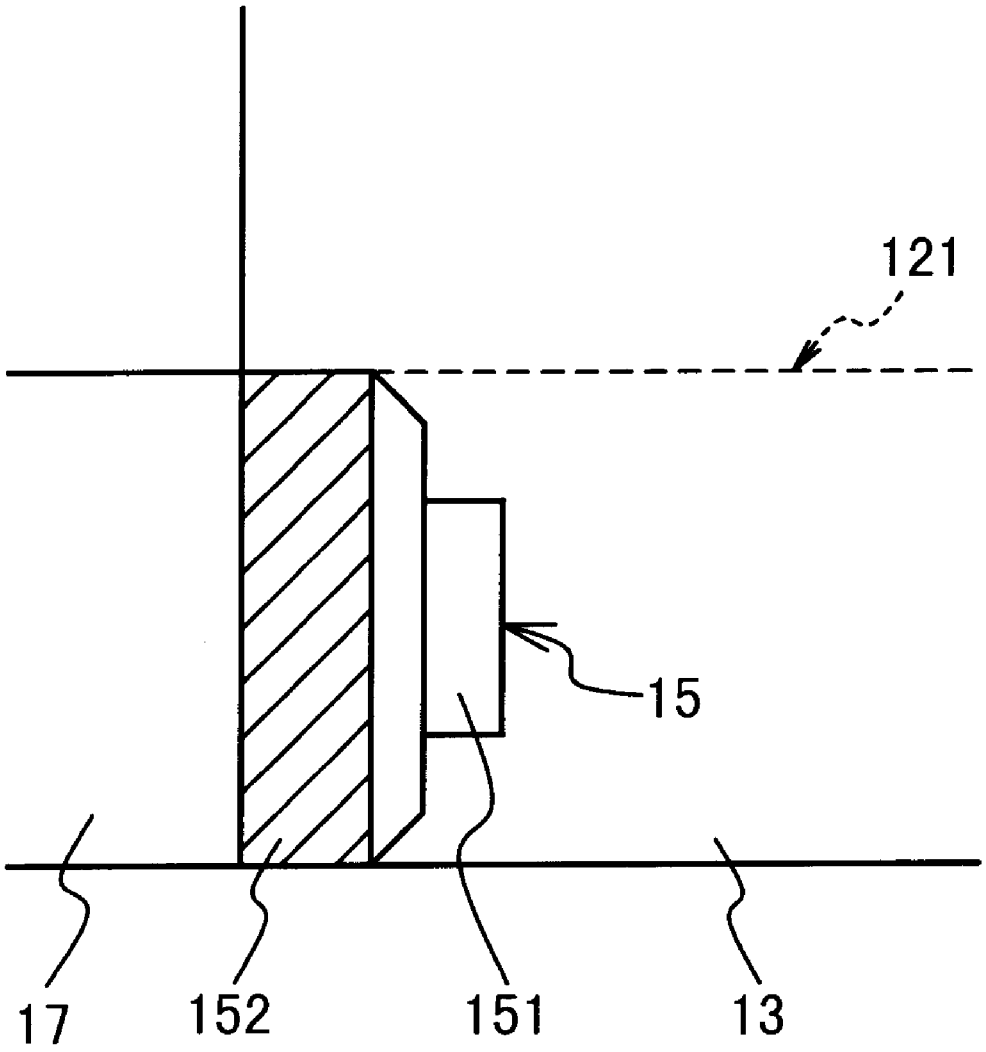
FIG. 2C is a section view showing an arrangement of a cooling unit constituting a part of a cooling section.

FIGS. 2A, 2B and 2C show the air conditioning apparatus according to the first embodiment of the present invention. FIG. 2A is a section view of the air conditioning apparatus according to the first embodiment of the present invention. FIG. 2B is a section view taken on the line A-A' of FIG. 2A. FIG. 2B mainly shows a structure of a cooling section. FIG. 2C is a section view showing an arrangement of a cooling unit constituting a part of the cooling section.

Referring now to FIGS. 2A, 2B and 2C a description will be made of the air conditioning apparatus according to the first embodiment of the present invention will be described below. FFUs 11 are set on a ceiling of a clean room interior 12. The clean room interior 12 and an under-floor portion 13 are partitioned with an access floor 121 as a boundary. A cooling section 14 is set in the under-floor portion 13. Also, a return shaft 17 is set in a portion outside the clean room.

The cooling section 14 is constituted by the combination of at least one of cooling units 15 and at least one of bypass units 16 shown in FIG. 2B. A cooling unit 15 is provided with a fan 151 and a cooling coil 152 shown in FIG. 2C.

The FFU 11 has a function of giving the pressure to the circulation air for compensating a pressure loss given to the circulation air which is passed through the bypass unit 16 in the cooling section 14 and to the FFUs 11.

The access floor 121 has a plurality of holes through which the circulation air can pass.

The circulation air passing through the cooling section 14 is divided into a part of the circulation air passing through the cooling unit 15 and the remaining circulation air passing through the bypass unit 16.

The cooling coil 152 in the cooling unit 15 cools the part of the circulation air passing through the cooling unit 15. The bypass unit 16 has a function that the remaining circulation air can be merely passing through the bypass unit 16. The pressure loss of the cooling coil 152 is larger than that of the bypass unit 16.

The fan 151 in the cooling unit 15 has a function of giving the pressure substantially equal to the pressure loss of the cooling coil 152 to the part of the circulation air.

The return shaft 17 has a function of mixing the part of the circulation air passing through the cooling unit 15 in the cooling section 14 and the remaining circulation air passed through the bypass unit 16 in the cooling section 14. And the return shaft 17 sends the mixture circulation air to the FFUs 11.

In the air conditioning apparatus according to the first embodiment of the present invention, the circulation air circulates in an order of an air flow 201, an air flow 202, an air flow 203 and an air flow 204 shown in FIG. 2A.

Next, an air conditioning method of the air conditioning apparatus according to a first embodiment of the present invention will be described.

At first, the circulation air blown by the FFU 11 set on the ceiling of the clean room interior 12 is passed through the clean room interior 12 and the access floor 121 and then entered in the under-floor portion 13. Then, the circulation air entered in the under-floor portion 13 is entered in the cooling section 14. A part of the circulation air entered in the cooling section 14 passes through the cooling unit 15, and the remaining circulation air passes through the bypass unit 16. Only the circulation air passing through the cooling unit 15 is cooled at this time. The part of the circulation air passing through the cooling unit 15 and the remaining circulation air passing through the bypass unit 16 is mixed by the return shaft 17, and then the mixture circulation air is returned to the FFUs 11.

Figure 1A:
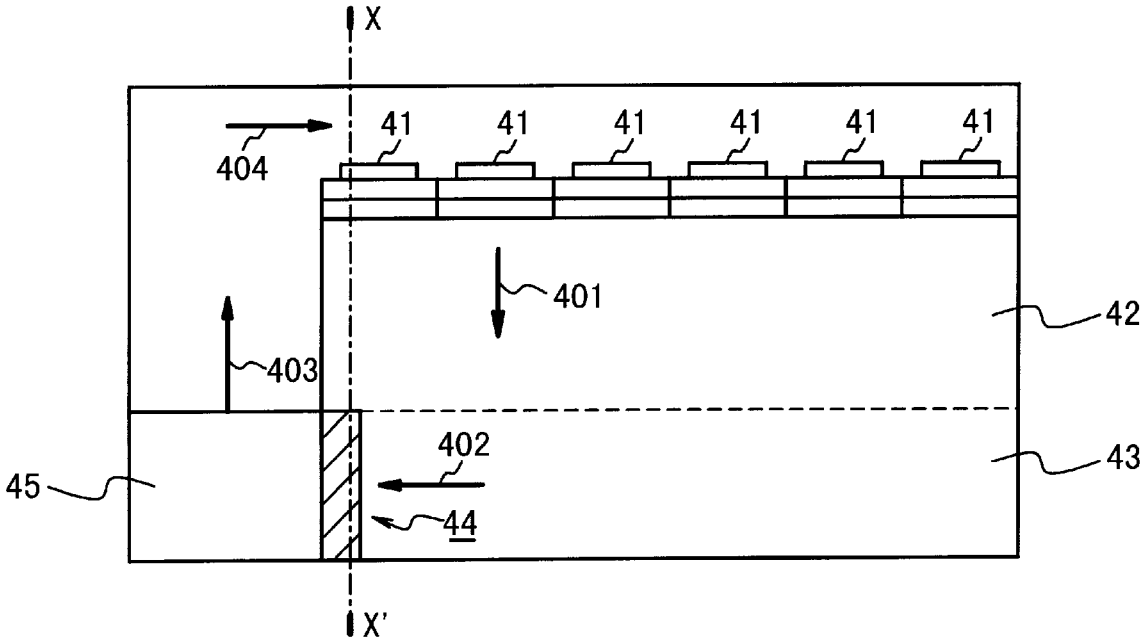
Fig. 1A PRIOR ART
FIG. 1A is a front section view showing a conventional air conditioning apparatus.
Figure 1B:
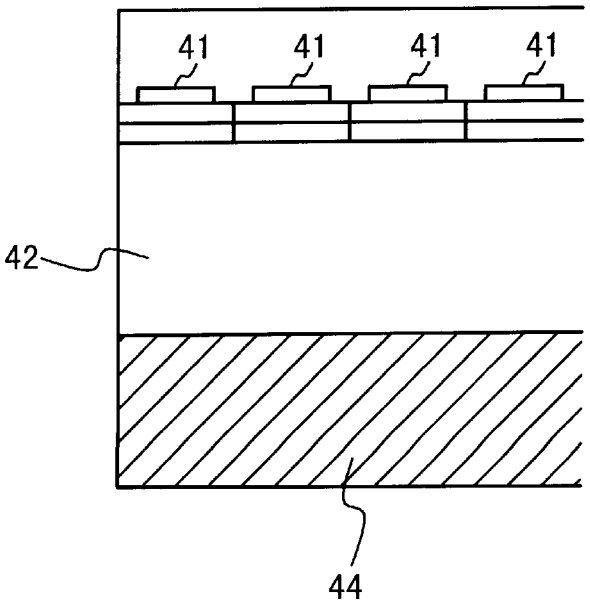
Fig. 1B PRIOR ART
FIG. 1B is a side section view showing a conventional air conditioning apparatus.

Here, it is compared with an electric power for circulating the circulation air in the air conditioning apparatus to the first embodiment the present invention and an electric power for circulating the circulation air in the conventional air conditioning apparatus shown in FIGS. 1A and 1B.

A circulation route of the circulation air in the air conditioning apparatus according to the first embodiment of the present invention is as follows. The circulation air blown by the FFUs 11 set on the ceiling of the clean room interior 12 passes through the clean room interior 12 and the access floor 121 to the under-floor portion 13. The circulation air entered in the under-floor portion 13 is entered in the cooling section 14. Then, a part of the circulation air passes through the cooling unit 15 and the remaining circulation air passes through the bypass unit 16. The part of the circulation air passing through the cooling unit 15 and the remaining circulation air passing through the bypass unit 16 are mixed by the return shaft 17, and the mixture circulation air is returned to the FFUs 11.

The circulation route of the circulation air in the conventional air conditioning apparatus shown in FIGS. 1A and 1B will be described. The circulation air blown by the FFUs 41 set on the ceiling of the clean room interior 42 passes through the clean room interior 42 and the access floor to the under-floor portion 43. The circulation air entered in the under-floor portion 43 passes through the cooling coil 44 to the return shaft 45, and then is returned to the FFUs 11.

In the circulation route of the air in the air conditioning apparatus according to the conventional technique, the circulation air entered in the under-floor portion 43 passes perfectly through the cooling coil 44 to the return shaft 45.

In the FFU, a filter pass static pressure adds to the circulation air passing through the filter in the FFU. Moreover, the pressure losses are given to the circulation air when the circulation air passes through the access floor, the under-floor portion, the bypass unit, the cooling coil, and the return shaft, respectively.

In the conventional air conditioning apparatus, the circulation air is circulated from the FFU through the access floor, the under-floor portion, the cooling coil and the return shaft. Thus, the sum of the filter pass static pressure and the pressure losses of the access floor, the under-floor portion, the cooling coil, and the return shaft respectively is given to the circulation air for circulating the circulation air in the conventional air conditioning apparatus.

The first embodiment in the air conditioning apparatus of the present invention has two air circulation paths. In the first air circulation path, the circulation air is circulated from the FFUs through the access floor, the under-floor portion, the cooling coil and the return shaft. In the second air circulation path, the circulation air is circulated from the FFUs through the access floor, the under-floor portion, the bypass unit and the return shaft. In the first circulation path, the total pressure of the filter pass static pressure and the pressure losses of the access floor, the under-floor portion, the cooling coil and the return shaft respectively, is given to the circulation air for circulating the circulation air in the invented air conditioning apparatus. In the second circulation path, the total presure of the filter pass static pressure and the pressure losses of the access floor, the under-floor portion, the bypass unit and the return shaft respectively, is given to the circulation air for circulating the circulation air in the invented air conditioning apparatus.

Here, A comparison with the electric power consumption of circulating the circulation air in the conventional air conditioning apparatus and that of circulating the circulation air in the inventive air conditioning apparatus according to the first embodiment of the present invention is attempted. The following conditions are selected for the comparison of the electric power consumptions of circulating the circulation air.

1. Initial conditions are that:
   - the floor area of clean room interior is 6,000 $m^2$;
   - the load of cooling the clean room interior is 2,700,000 kcal/h;
   - the quantity of circulating air is 3,000,000 $m^3$/h;
   - the pressure loss given to air passing through the filter of the FFU is 10 mmAq;
   - the pressure loss given to air passing through the access floor is 2 mmAq;
   - the pressure loss given to air passing through the under-floor portion is 2 mmAq;
   - the pressure loss given to air passing through the bypass unit is 2 mmAq;
   - the pressure loss given to air passing through the cooling coil is 5 mmAq; and
   - the pressure loss given to air passing through the return shaft is 1 mmAq.

Or, as constants;
   - the specific gravity per volume of air is 1.2 kg/$m^3$ (at Temperature of 20° C.);
   - the specific heat per volume of air is 0.24 kcal/kg;
   - the work amount of fan per electric power is 102; and
   - the efficiency of fan is 0.4.
2. The quantity of air passing through the cooling unit and that of air passing through the bypass unit in the air conditioning apparatus of the present invention are defined as follows in the first embodiment in the air conditioning apparatus of the present invention.

2,700,000/((1.2×0.24)×9° C. )≈1,000,000 $m^3$/h (quantity of the cooled air passing through the cooling unit per hour)

3,000,000 $m^3$/h−1,000,000 $m^3$/h=2,000,000 $m^3$/h (quantity of the non-cooled air passing through the bypass unit per hour)
3. It is compared with the electric power consumption in conventional technique and that in first embodiment of present invention.

In the air conditioning apparatus of the conventional technique, the circulation air is perfectly passed through the cooling coil. The electric power required to circulate the circulation air is:

(3,000,000×20)/(102×60×60×0.4)=408.5 KW. In the air conditioning apparatus according to the first embodiment of the present invention, the quantity of the circulation air passed through the cooling coil is 1,000,000 $m^3$/h, and the quantity of the circulation air passed through the bypass unit is 2,000,000 $m^3$/h. The electric power required to circulate the part of circulation air passing through the cooling coil is:

(1,000,000×20)/(102×60×60×0.4)=136.2 KW.

The electric power required to circulate the remaining circulation air passing through the bypass unit is:

(2,000,000×17)/(102×60×60×0.4)=231.5 KW.

Thus, in the air conditioning apparatus according to the first embodiment of the present invention, the electric power required to circulate the circulation air is 136.2 KW+231.5 KW=367.7 KW.

The difference of the electric power required to circulate the circulation air in the air conditioning apparatus according to the conventional technique and that in the air conditioning apparatus according to the first embodiment of the present invention is:

408.5 KW−367.7 KW=40.8 KW.

The air conditioning apparatus according to the first embodiment of the present invention can improve the efficiency of the electric power consumption by about 10 per cent, as compared with that according to the conventional technique.

Second, an air conditioning apparatus according to a second embodiment of the present invention will be described below with reference to the attached drawings.

Figure 3A:
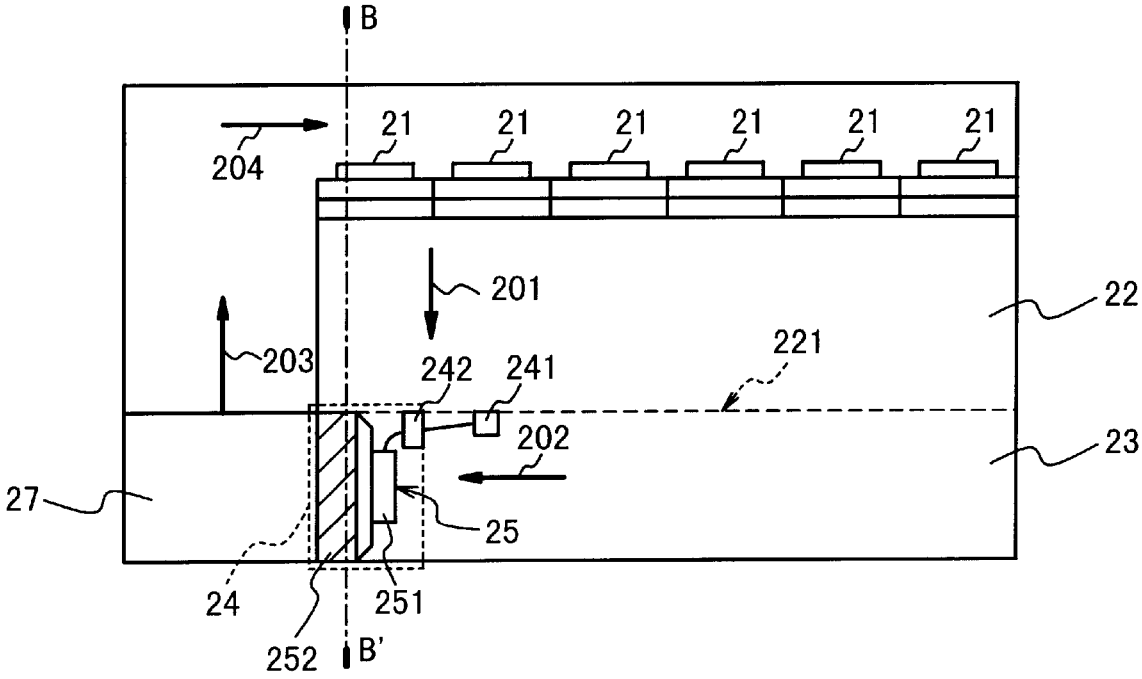
FIG. 3A is a section view showing a configuration of a second embodiment in the air conditioning apparatus of the present invention.
Figure 3B:
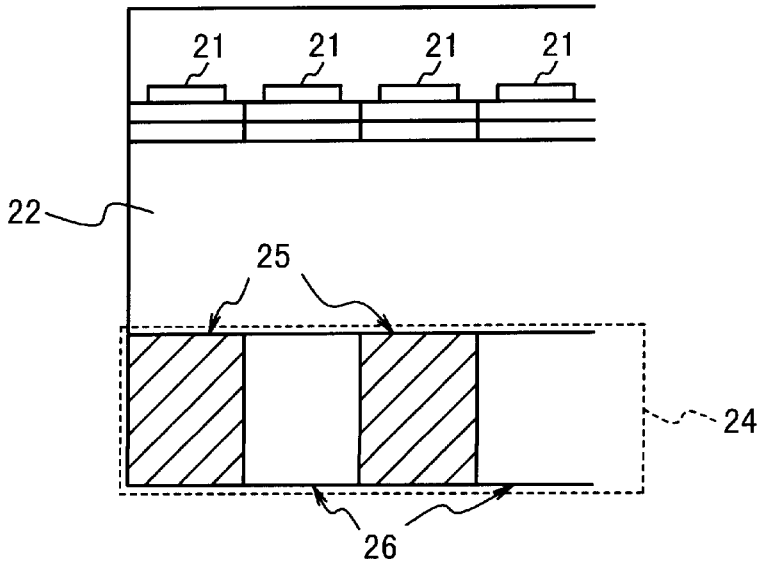
FIG. 3B is a view showing a part of a structure of a section taken on the line B-B' of FIG. 3A.
Figure 3C:
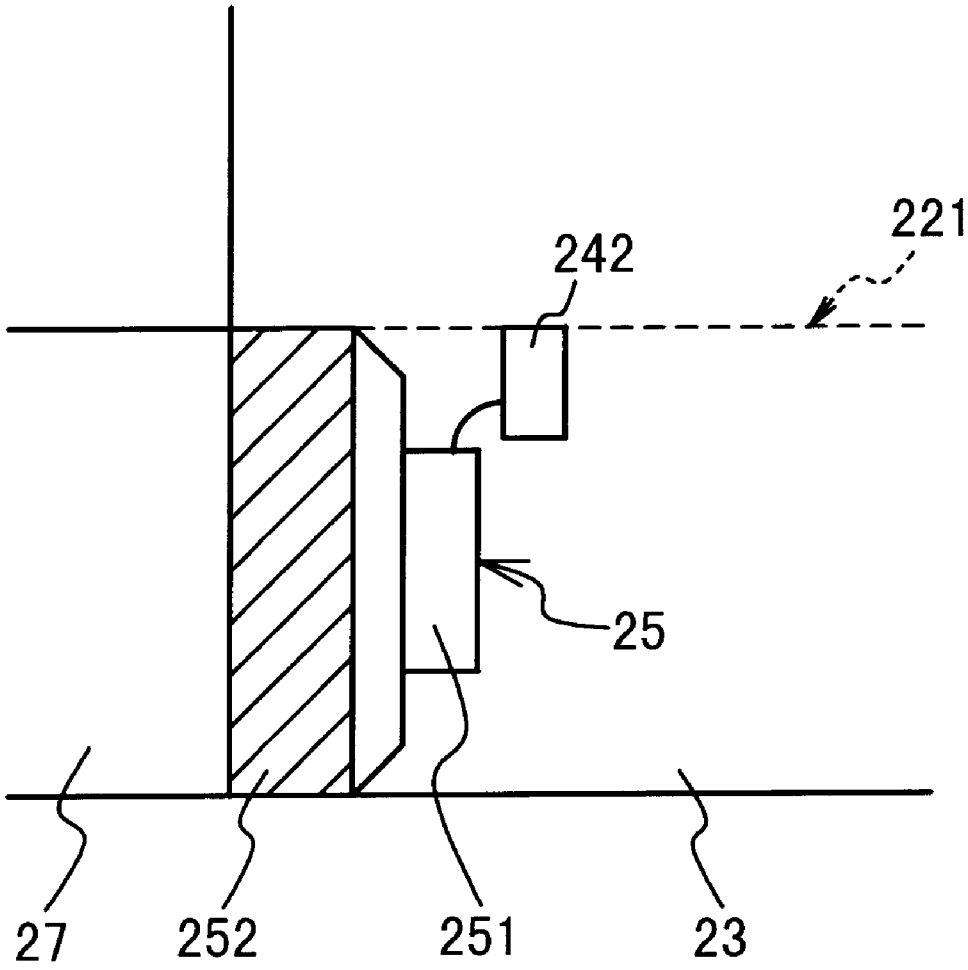
FIG. 3C is a section view showing an arrangement of a cooling unit constituting a part of a cooling section.

FIGS. 3A, 3B and 3C show the air conditioning apparatus according to the second embodiment of the present invention. FIG. 3A is a section view of the air conditioning apparatus according to the second embodiment of the present invention. FIG. 3B is a section view taken on the line B-B' of FIG. 3A. FIG. 3B mainly shows the structure of a cooling section. FIG. 3C is a section view showing an arrangement of a cooling unit constituting a part of the cooling section.

Referring now to FIGS. 3A, 3B and 3C a description will be made of the air conditioning apparatus according to the second embodiment of the present invention will be described below. FFUs 21 are set on a ceiling of a clean room interior 22. The clean room interior 22 and an under-floor portion 23 are partitioned with an access floor 221 as a boundary. A cooling section 24 is set in the under-floor portion 23. Also, a return shaft 27 is set in a portion outside the clean room.

Shown in FIG. 3B, the cooling section 24 is constituted by the combination of at least one of cooling units 25 and at least one of bypass units 26. Also, the cooling unit 25 consists of a wind quantity changeable unit 251 and a cooling coil 252 shown in FIG. 3C. Moreover, the wind quantity changeable unit 251 is linked to a temperature controller 242. This wind quantity changeable unit 251 has a function of giving a wind pressure for compensating a pressure loss of the cooling coil 252. Also, it is provided with a temperature measuring section 241 and the temperature controller 242 in the cooling unit 25. The temperature measuring section 241 measures a temperature of the circulation air. The temperature controller 242 controls the quantity of the wind which the wind quantity changeable unit 251 sends to the cooling coil 252 according to the temperature measured by the temperature measuring section 241.

The temperature measuring section 241 measures a temperature of the circulation air given an amount of heat generated in the clean room. It is desirable that the temperature measuring section 241 is set at the under-floor portion 23 of the clean room or the access floor 221. Also, the temperature measuring section 241 may be set at the wind quantity changeable unit 251 of the cooling section 24.

In the air conditioning apparatus according to the second embodiment of the present invention, the circulation air circulates in an order of an air flow 201, an air flow 202, an air flow 203 and an air flow 204, shown in FIG. 3A.

In the air conditioning apparatus according to the second embodiment of the present invention, it is characterized that it is provided with a temperature measuring section 241 and the temperature controller 242 in the cooling unit 25, compared with that according to the first embodiment of the present invention. The temperature measuring section 241 measures a temperature of the circulation air. The temperature controller 242 controls the quantity of the air which the wind quantity changeable unit 251 sends to the cooling coil 252 based on the temperature measured by the temperature measuring section 241.

Here, in the air conditioning apparatus according to the second embodiment of the present invention, the quantity of air circulated in the air conditioning apparatus is decided not for keeping cool from an amount of heat generated in the clean room but for keeping the clean room clean. According to the temperature measured by the temperature measuring section 241, the temperature controller 242 controls the quantity of the air blown into the cooling coil 252 by the wind quantity changeable unit 251 to remove heat substantially equal to an amount of heat generated in the clean room. As a result, it Is possible to control the quantity of the air passing through the cooling coil 252. Thus, it is possible to compensate an amount of heat generated in the clean room to reduce the pressure loss given to the circulation air to a substantial minimum. Hence, it is possible to improve the efficiency of the electric power consumption necessary for circulating the air circulation.

Here, an operational example of the temperature controller 242 is described. The temperature controller 242 has a pre-determined temperature in the circulation air. The temperature controller 242 controls the quantity of air blown into the cooling coil 252 by the wind quantity changeable unit 251 based on a comparison with the pre-determined temperature and the temperature measured by the temperature measuring section 241.

Here, the temperature controller 242 may control the quantity of the air in each wind quantity changeable unit 251 and also control the number of the wind quantity changeable units 251 which drive.

Third, an air conditioning apparatus according to third embodiment of the present invention will be described below with reference to the attached drawings.

Figure 4A:
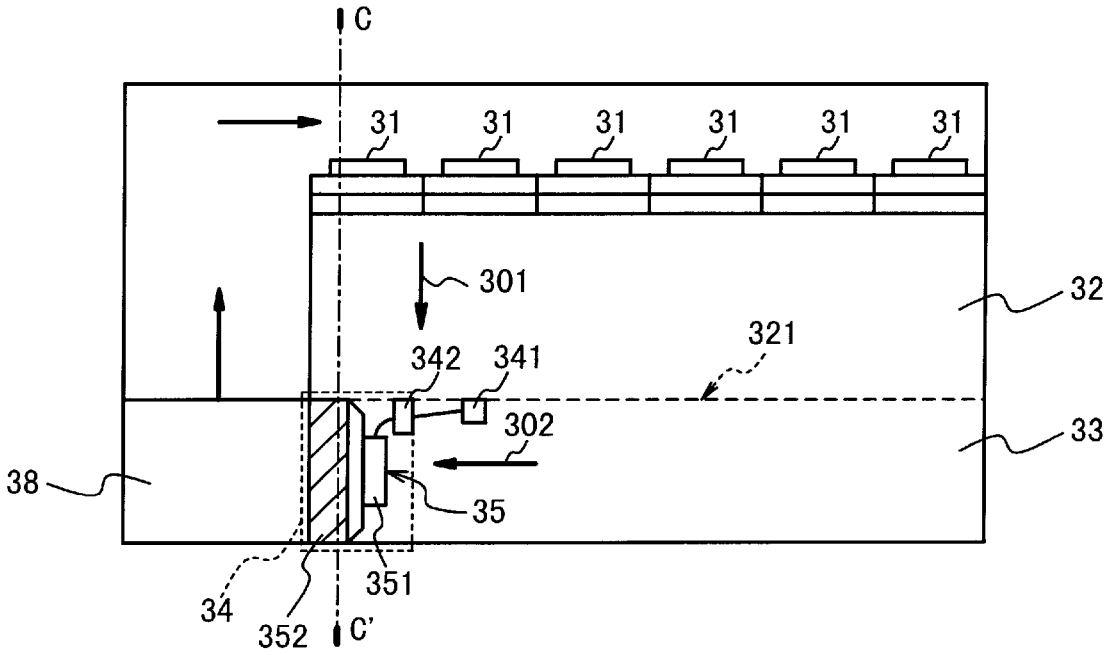
FIG. 4A is a section view showing a configuration of a third embodiment in the air conditioning apparatus of the present invention.
Figure 4B:
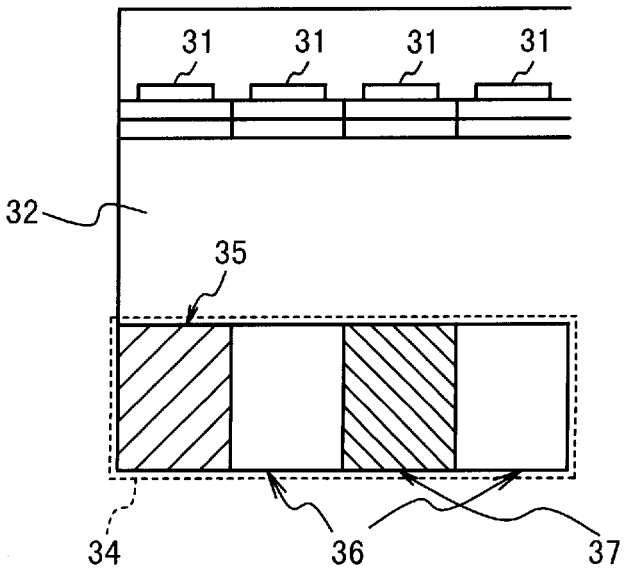
FIG. 4B is a view showing a part of a structure of a section taken on the line C-C' of FIG. 4A.
Figure 4C:
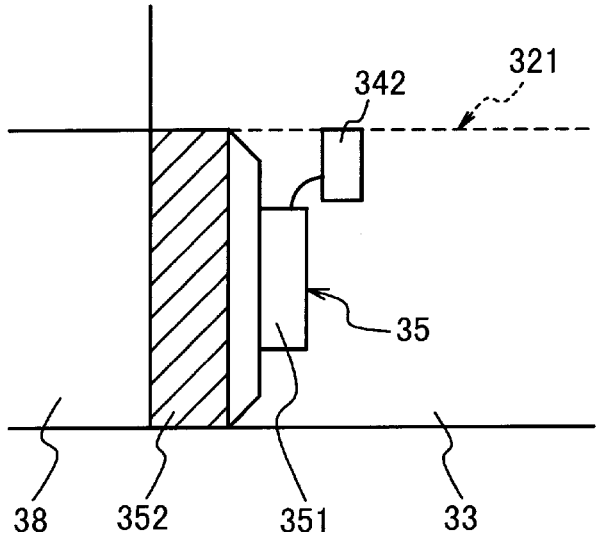
FIG. 4C is a section view showing an arrangement of a cooling unit constituting a part of a cooling section.
Figure 4D:
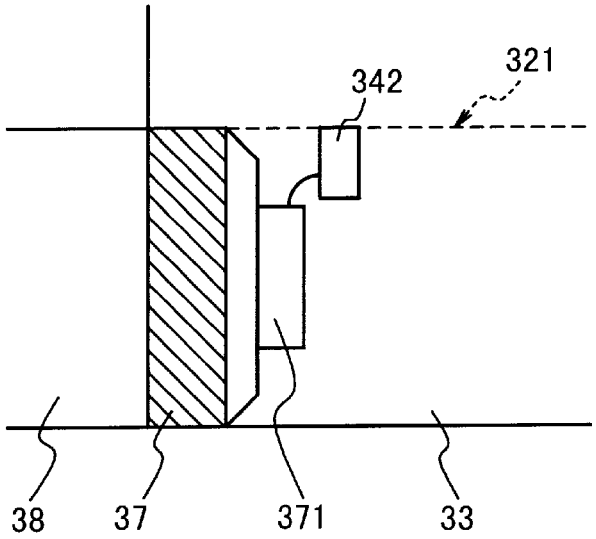
FIG. 4D is a section view showing an arrangement of an air adjusting unit constituting a part of the cooling section.

FIGS. 4A, 4B and 4C show the air conditioning apparatus according to the third embodiment of the present invention. FIG. 4A is a section view of the air conditioning apparatus according to the third embodiment of the present invention. FIG. 4B is a section view taken on the line C-C' of FIG. 4A. FIG. 4B mainly shows the structure of a cooling section. FIG. 4C is a section view showing an arrangement of a cooling unit constituting a part of the cooling section. FIG. 4D is a section view showing an arrangement of an air conditioning unit constituting a part of the cooling section.

Referring now to FIGS. 4A, 4B, 4C and 4D a description will be made of the air conditioning apparatus according to the third embodiment of the present invention will be described below. FFUs 31 are set on a ceiling of a clean room interior 32. The clean room interior 32 and an under-floor portion 33 are partitioned with an access floor 321 as a boundary. A cooling section 34 is set in the under-floor portion 33. Also, a return shaft 38 is set in a portion outside the clean room.

Shown in FIG. 4B, the cooling section 34 is set by the combination of a cooling unit 35, a bypass unit 36 and an air conditioning unit 37.

Also, the cooling unit 35 consists of a wind quantity changeable unit 351 and a cooling coil 352 shown in FIG. 4C. This wind quantity changeable unit 351 has a function of giving to the air passing through the cooling coil 352 a pressure which is substantially equal to a pressure loss given to the air passing through the cooling coil 352. The variable wind quantity unit 351 is linked to a temperature humidity controller 342.

Also, a wind quantity changeable unit 371 is set in an air conditioning unit 37 shown in FIG. 4D. This wind quantity changeable unit 371 has a function of giving to the air passing through the air conditioning unit 37 a pressure which is substantially equal to a pressure loss given to the air passing through the air conditioning unit 37. The wind quantity changeable unit 371 is linked to the temperature humidity controller 342.

The air conditioning apparatus according to third embodiment of the present invention has a temperature humidity measuring section 341, the temperature humidity controller 342 and the wind quantity changeable units 351, 371. The temperature humidity measuring section 341 measures a temperature and a humidity of the circulation air in the air conditioning apparatus. According to the temperature and a humidity of the circulation air measured by the temperature humidity measuring section 341, the temperature humidity controller 342 controls the wind quantity changeable unit 351, 371 to adjust the quantity of air blown into the cooling unit 35 and the air adjusting unit 37.

In the air conditioning apparatus according to the third embodiment of the present invention, the circulation air circulates in an order of an air flow 401, an air flow 402, an air flow 403 and an air flow 404 shown in FIG. 4A.

The air conditioning apparatus according to the third embodiment of the present invention further includes the air adjusting unit 37 and the variable wind quantity unit 371 in the cooling unit 34, compared with the air conditioning apparatus according to the second embodiment of the present invention. Moreover, the air conditioning apparatus according to the third embodiment of the present invention includes the temperature humidity measuring section 341 and the temperature humidity controller 342 instead of the temperature measuring section 241 and the temperature controller 242 in the air conditioning apparatus according to the second embodiment of the present invention, respectively. The temperature humidity measuring section 341 measures the temperature and the humidity of the circulation air. The temperature humidity controller 342 controls the wind quantity changeable unit 351 and the wind quantity changeable unit 371 to adjust the quantity of the air blown into the cooling unit 35 and/or that of the air blown into the air adjusting unit 37, based on the temperature and the humidity measured by the temperature humidity measuring section 341.

Here, the temperature humidity measuring section 341 measures the temperature and the humidity of the circulation air and the temperature and the humidity are changed in response to the load given in the clean room. It is desirable that the temperature humidity measuring section 341 is set at the under-floor portion 33 of the clean room or the access floor 321. Moreover, the temperature humidity measuring section 341 may be set at the variable wind quantity units 351, 371 in the cooling section 34.

Here, in the air conditioning apparatus according to the third embodiment of the present invention, the quantity of air circulated in the air conditioning apparatus is decided not for keeping cool from an amount of heat generated in the clean room but for keeping the clean room clean.

According to the temperature and the humidity measured by the temperature humidity measuring section 341, the temperature controller 242 controls the quantity of the air blown into the cooling coil 352 and the air conditioning unit 37 to remove the load substantially equal to the load generated in the clean room. It is possible to control each of the quantity of the air passed through the cooling coil 352 and passed through the air conditioning unit 37. Thus, it is possible to compensate a load generated in the clean room to reduce the pressure loss given to the circulation air substantially to a minimum. Hence, it is possible to improve the efficiency of the electric power consumption necessary for circulating the air circulation.

Here, an operational example of the temperature humidity controller 342 is described. The temperature humidity controller 342 has a pre-determined temperature and humidity in the circulation air, respectively. The temperature humidity controller 342 controls the quantity of air blown into the cooling coil 352 by the wind quantity changeable unit 351 and that blown into the air conditioning unit 37 by the wind quantity changeable unit 371 according to the result of the comparison between the pre-determined temperature and humidity, and the temperature and humidity measured by the temperature measuring section 341, respectively.

Here, the temperature humidity controller 342 can control the quantity of the wind in each wind quantity changeable unit 351, 371 and also control the number of the wind quantity changeable units 251, 371 which drive.

Moreover, in the air conditioning apparatus according to the third embodiment of the present invention, according to any one of the temperature and the humidity of the circulation air measured by the temperature humidity measuring section 341, the temperature humidity controller 342 controls the operations of the wind quantity changeable unit 351 in the cooling unit 35 and the wind quantity changeable unit 371 set in the air conditioning unit 37 to adjust the quantity of the wind passed through the cooling unit 35 and the quantity of the air passed through the air conditioning unit 37.

Also, in the above-mentioned air conditioning apparatus of the present invention, it is possible to arbitrarily determine and change the arrangements of the cooling unit, the bypass unit and the air conditioning unit in the cooling section. Moreover, it is possible to freely change a unit width of the bypass unit. In short, the air conditioning apparatus of the present invention has the feature that the layout in the cooling section is determined freely.

What is claimed is:

1. An air conditioning apparatus comprising:

a clean room;

an air cleaning section cleaning air to supply to said clean room as cleaned air;

a cooling section which comprises, a plurality of cooling units cooling air from said clean room to send out as cooled air, and a plurality of non-cooling units sending out as non-cooled air from said clean room without cooling air, wherein each of the quantity of said cooled air and said non-cooled air is determined to compensate an amount of heat generated in said air conditioning apparatus and to reduce a pressure loss given to said air passing through said cooling section to a substantial minimum; and an air mixing section mixing said cooled air and said non-cooled air to supply to said air cleaning section, such that said cleaned air is circulated through said clean room, said cooling section and said air mixing section to said air cleaning section.

2. An air conditioning apparatus according to claim 1, wherein said air cleaning section gives a first pressure to said cleaned air to circulate said cleaned air through said clean room, said non-cooling unit in said cooling section and said air mixing section to said air cleaning section; and said cooling section gives a second pressure to said cooled air to compensate said pressure loss given to said air passing through said cooling unit.

3. An air conditioning apparatus according to claim 1, wherein said air cleaning section comprises:

a fan filter unit comprising a filter and a fan, wherein said fan sucks air and sends said sucked air to said filter and said filter cleans said air sent by said fan.

4. An air conditioning apparatus according to claim 1, wherein said cooling unit comprises:

a cooling equipment cooling said cooled air, and a fan motor giving a fan pressure to said cooled air, wherein said fan pressure compensates for said pressure loss given said cooled air passing through said cooling equipment.

5. An air conditioning apparatus according to claim 4, wherein said fan motor further comprises:

a temperature measuring section measuring a temperature of circulation air circulated in said air conditioning apparatus; and a temperature controller storing a pre-determined temperature and controlling a quantity of said circulation air passing through said cooling equipment, based on a comparison with said measured temperature and said pre-determined temperature.

6. An air conditioning apparatus according to claim 4, further comprising:

a temperature measuring section of measuring a temperature of circulation air circulated in said air conditioning apparatus; and a temperature controller storing a pre-determined temperature and controlling a number of said fan motors to be driven, based on a comparison with the measured temperature and said pre-determined temperature.

7. An air conditioning apparatus according to claim 1, wherein at least one of said cooling unit comprises:

an air conditioning unit adjusting a temperature and a humidity of air passing through said air conditioning unit, and wherein said cooling section divides said air passing through said cooling section into said cooled air, non-cooled air and a conditioned air passing through said air conditioning unit to compensate said amount of heat generated in said air conditioning apparatus and to reduce the pressure loss given to said air passing through said cooling section to a substantial minimum.

8. An air conditioning apparatus according to claim 7, further comprising:

a temperature humidity measuring section of measuring a temperature and a humidity of circulation air; and a temperature humidity controller storing a pre-determined temperature and a pre-determined humidity of said circulation air, and controlling a quantity of said cooled air and said conditioned air based on a comparison with said measured temperature and said pre-determined temperature and another comparison with said measured humidity and said pre-determined humidity.

9. An air conditioning apparatus according to claim 7, further comprising:

a temperature humidity measuring section measuring a temperature and a measured humidity of circulation air; and a temperature humidity controller storing a pre-determined temperature and a pre-determined humidity of said circulation air, and controlling the numbers of said air controlling units to be driven and said cooling units to be driven based on a comparison with said measured temperature and said pre-determined temperature and another comparison with said measured humidity and said pre-determined humidity.

10. An air conditioning apparatus according to claim 7, wherein an arrangement of said cooling units, said non-cooling units and said air conditioning units are changeable in said cooling section.

11. An air conditioning apparatus according to claim 1, wherein an arrangement of said cooling units and said non-cooling units are changeable in said cooling section.

12. An air conditioning method of an air conditioning apparatus including a clean room; an air cleaning section of cleaning air passing through said air cleaning section; a cooling section including a plurality of cooling units of cooling air passing through said plurality of cooling units and a plurality of non-cooling units without cooling air passing through said plurality of non-cooling units; and an air mixing section mixing said air passing through said plurality of cooling units and said air passing through said plurality of non-cooling units; comprising:

(a) giving a pressure to circulation air circulated in said air conditioning apparatus to circulate said circulation air through said clean room, said non-cooling unit in said cooling section and said air mixing section to said air cleaning section;

(b) dividing said circulation air passing through said cooling section into a first air passing through said plurality of cooling units and a second air passing through said plurality of non-cooling units to cool said first air based on an amount of heat generated in said air conditioning apparatus and to reduce a pressure loss given to said circulation air passing through said cooling section to a substantial minimum; and (c) giving to said first air a pressure substantially equal to a pressure loss given to said first air passing through said cooling unit.

13. An air conditioning method according to claim 12, wherein said (b) dividing said circulation air comprises:

(d) determining a pre-determined temperature;

(e) measuring a temperature of said circulation air before passing through said cooling section; and (f) dividing said circulation air passing through said cooling section into a quantity of said first air passing through said plurality of cooling units and a quantity of a second air passing through said plurality of non-cooling units based on a comparison with said measured temperature and said pre-determined temperature to reduce said pressure loss given to said air passing through said cooling section to a substantial minimum.

14. An air conditioning method according to claim 13, wherein said (c) giving to said first air further comprises:

(g) controlling the quantity of said first air based on the result of said (f) dividing said circulation air.

15. An air conditioning method according to claim 12, wherein a part of said cooling units include air conditioning units of changing a temperature and a humidity of an air passing through said air conditioning units, and said (b) dividing said circulation air comprises (h) dividing said circulation air passing through said cooling section into a first air passing through said plurality of cooling units, a second air passing through said plurality of non-cooling units and a third air passing said air conditioning units to cool said first air and said third air in response to said amount of heat generated in said air conditioning apparatus and to reduce said pressure loss given to said circulation air passing through said cooling section to a substantial minimum, and further comprising:

(i) giving to said third air a pressure substantially equal to a pressure loss given to said third air passing through said air conditioning units.

16. An air conditioning method according to claim 15, further comprising:

(j) determining a pre-determined temperature and a pre-determined humidity; and (k) measuring a temperature and a humidity of said circulation air before passing through said cooling section; and wherein said (h) dividing said circulation air comprises (l) dividing said circulation air passing through said cooling section into a first air passing through said plurality of cooling units, a second air passing through said plurality of non-cooling units and a third air passing said air conditioning units to cool said first air and said third air and to adjust a humidity of said third air based on a comparison with said measured temperature and said pre-determined temperature and another comparison with said measured humidity and said pre-determined humidity to reduce said pressure loss given to said circulation air passing through said cooling section to a substantial minimum.

17. An air conditioning method according to claim 16, wherein said (c) giving a pressure to said first air further comprises:

(m) controlling the quantity of said first air based on said (l) dividing said circulation air; and wherein said (i) further comprises:

(n) controlling the quantity of said third air based on said (l) dividing said circulation air.

18. An air conditioning apparatus of a clean room comprising:

an air cleaning portion cleaning air passing through said air cleaning section;

a cooling portion which comprises;

a plurality of cooling units cooling air passing through said cooling units; and a plurality of non-cooling units without cooling air passing through said non-cooling units;

an air mixing portion; and an air circulating section circulating a first air cleaned by said air cleaning portion, through said clean room, said cooling portion and said air mixing portion to said air cleaning portion, wherein said cooling portion comprises:

a dividing section dividing said first air passing through said cooling section into a second air passing through said plurality of cooling units and a third air passing through said plurality of non-cooling unit; and a cooling section cooling said second air in said plurality of cooling units, and said air mixing portion comprises:

a mixing section mixing said second air cooled by said cooling section and said third air.

19. An air conditioning apparatus of a clean room according to claim 18, wherein each of said plurality of cooling units comprises:

an cooling apparatus; and an wind supplying apparatus supplying said second air to said cooling apparatus.

20. An air conditioning apparatus according to claim 19, wherein said wind supplying apparatus comprises:

a storing area storing a pre-determined temperature;

a first temperature measuring section measuring a temperature of a circulation air circulated in said air conditioning apparatus; and a controller controlling a quantity of said second air supplied to said cooling apparatus based on a comparison with said measured temperature and said pre-determined temperature.

21. An air conditioning apparatus according to claim 18, wherein said cooling section further comprises:

a plurality of air conditioning units; and a dividing section dividing said first air passing through the cooling section into a second air passing through said plurality of cooling units, a third air passing through said plurality of non-cooling units and a fourth air passing through said plurality of air adjusting units;

said air conditioning unit further comprises:

a storing area storing a pre-determined temperature and a pre-determined humidity;

a second temperature humidity measuring section measuring a temperature and a measured of said circulation air; and an adjusting section adjusting a temperature and a humidity of said fourth air passing through said air conditioning unit based on a comparison with said measured temperature and said pre-determined temperature and another comparison with said measured humidity and said pre-determined humidity; and wherein said mixing section mixes said second air, said third air and said fourth air passing through said cooling section.

* * * * *